US007360585B2

(12) United States Patent
Berggren et al.

(10) Patent No.: US 7,360,585 B2
(45) Date of Patent: Apr. 22, 2008

(54) HEAT EXCHANGER COOLING FIN

(75) Inventors: Göte Gunnar Berggren, Lidkuping (SE); Bengt Åke Viklund, Grasturp (SE)

(73) Assignee: Bundy Refrigeration International Holding B.V., Rotterdam (NL)

( * ) Notice: Subject to any disclaimer, the term of this patent is extended or adjusted under 35 U.S.C. 154(b) by 0 days.

(21) Appl. No.: 10/572,133

(22) PCT Filed: Sep. 19, 2003

(86) PCT No.: PCT/GB03/04139

§ 371 (c)(1),
(2), (4) Date: Sep. 18, 2006

(87) PCT Pub. No.: WO2005/028988

PCT Pub. Date: Mar. 31, 2005

(65) Prior Publication Data

US 2007/0017663 A1 Jan. 25, 2007

(51) Int. Cl.
*F28F 1/32* (2006.01)

(52) U.S. Cl. ..... 165/151; 165/DIG. 502; 165/DIG. 503

(58) Field of Classification Search ..... 165/151, 165/171; 62/456
See application file for complete search history.

(56) References Cited

U.S. PATENT DOCUMENTS

| | | | | |
|---|---|---|---|---|
| 2,703,702 | A * | 3/1955 | Meinel | 165/128 |
| 3,224,503 | A * | 12/1965 | Konanz | 165/171 |
| 3,379,241 | A * | 4/1968 | Gau | 165/53 |
| 3,380,518 | A * | 4/1968 | Taverna et al. | 165/171 |
| 5,046,556 | A | 9/1991 | Anderson | |
| 5,168,923 | A * | 12/1992 | Sacks | 165/151 |
| 5,797,451 | A * | 8/1998 | Grant | 165/171 |
| 5,915,471 | A * | 6/1999 | Kim | 165/151 |
| 6,976,529 | B2 * | 12/2005 | Kester | 165/151 |
| 2005/0077036 | A1 * | 4/2005 | Antonijevic | 165/182 |

FOREIGN PATENT DOCUMENTS

| | | | |
|---|---|---|---|
| FR | 1280498 | A | 12/1961 |
| FR | 1524182 | A | 5/1968 |
| FR | 1571879 | A | 6/1969 |
| GB | 1369290 | A | 10/1974 |

* cited by examiner

*Primary Examiner*—Allen J. Flanigan
(74) *Attorney, Agent, or Firm*—Leydig, Voit & Mayer, Ltd.

(57) ABSTRACT

A heat exchanger cooling fin (401), for use in a fluid flow environment, comprising a fin plate (402) having a series of substantially mutually parallel louvres (403), each louvre (403) having a convex curved surface (404) facing in the opposite direction to each adjacent louvre (403), said series of louvres defining a nominal fluid flow path along the series over said convex curved surface (404) of each louvre (403).

23 Claims, 10 Drawing Sheets

HEAT EXCHANGER COOLING FIN

BACKGROUND OF THE INVENTION

1. Field of the Invention

The present invention relates to a heat exchanger cooling fin, in particular a heat exchanger cooling fin having louvres.

2. Description of the Related Art

A heat exchanger is a device for transferring heat from one fluid to another without the two fluids mixing. Heat exchangers are used in various industries, for example automotive and refrigeration industries, and thus different designs are known.

A type of heat exchanger uses a heat transfer element, for example tubing, within which a first fluid flows, placed within a free or forced flow of air. Heat transfer in the direction from the fluid within the heat transfer element to the air surrounding the tubing, may be enhanced by the provision of metal cooling fin plates secured in contact with the heat transfer element. However, as air flows over the fin plates, an air insulative boundary layer forms with increasing thickness along the surface of the fin plate. This effect potentially degrades the heat transfer efficiency of the heat exchanger, and thus various cooling fin designs utilise louvres, raised from the plane of the fin, which function to disrupt the formation of the boundary layer and to create turbulence, thus improving the practical efficiency of the fin plates and, in turn, the heat exchanger.

BRIEF SUMMARY OF THE INVENTION

According to a first aspect of the present invention there is provided a heat exchanger cooling fin for use in a fluid flow environment, comprising a fin plate having a series of substantially mutually parallel louvres, each louvre having a convex curved surface facing in the opposite direction to each adjacent louvre, said series of louvres defining a nominal fluid flow path along the series over said convex curved surface of each louvre.

According to a second aspect of the present invention there is provided a heat exchanger having a heat exchanger cooling fin, for use in a fluid flow environment, said heat exchanger cooling fin comprising a fin plate having a series of louvres arranged to direct fluid flow from a first side of said fin plate to the second side of the fin plate and back to said first side of the fin plate, and said heat exchanger comprising tubing in heat transfer contact with the fin plate, said tubing extending in a direction along said series of louvres.

According to a third aspect of the present invention there is provided a heat exchanger having a heat exchanger cooling fin, for use in a fluid flow environment, said heat exchanger cooling fin comprising a fin plate having a series of louvres arranged to direct free convection fluid flow from a first side of said fin plate to the second side of the fin plate and back to said first side of the fin plate.

WRITTEN DESCRIPTION OF THE BEST MODE FOR CARRYING OUT THE INVENTION

FIG. 1

Figure 1:
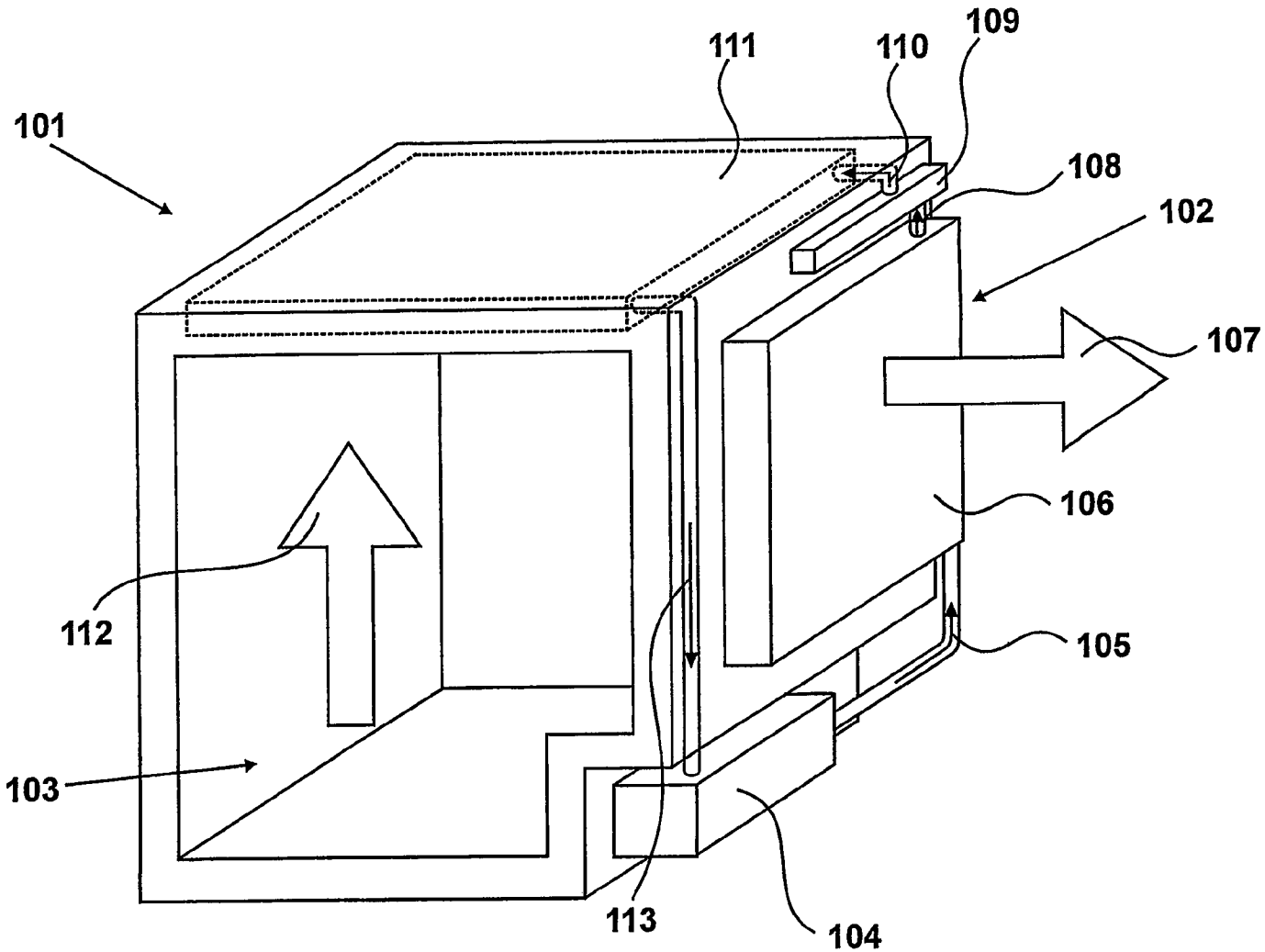
FIG. 1 shows a schematic of a practical refrigeration system.

FIG. 1 shows a schematic of a practical refrigeration system. Refrigeration unit 101 incorporates a refrigeration operating system 102, configured to operate a vapour-compression refrigeration cycle arrangement. The components of the refrigeration operating system 102 are arranged about the refrigeration cavity 103 of the refrigeration unit 101, in which items to be kept a temperature lower than that of the ambient surroundings are storable.

Flowing inside the circuit of the refrigeration operating system 102 is a refrigerant. According to the shown refrigeration cycle arrangement, refrigerant enters compressor 104 as saturated vapour, flowing in the direction of arrow 105 towards condenser 106. As the refrigerant flows through compressor 104, it is compressed to the pressure of the condenser 106. During this compression, the temperature of the refrigerant increases above the temperature of the surrounding environment. The refrigerant enters condenser 106 as superheated vapour. In the condenser 106, the refrigerant condenses to a saturated liquid. During this process, the refrigerant rejects heat to the surrounding environment, indicated generally by arrow 107, via the condenser 106. On leaving the condenser 106, the refrigerant still has a temperature above the temperature of the surrounding environment, and flows in the direction of arrow 108 towards capillary tube 109. As the refrigerant flows through capillary tube 109, in the direction indicated by arrows 108 and 110, the refrigerant is throttled to the pressure of evaporator 111. During this process, the temperature of the refrigerant decreases below the temperature of the refrigeration cavity, entering evaporator 111 as a saturated mixture. The refrigerant absorbs heat from within the refrigeration cavity, indicated generally by arrow 112, via the evaporator 111. The refrigerant evaporates to form a saturated vapour before flowing from the evaporator 111, in the direction of arrow 113, to compressor 104. The refrigerant re-enters compressor 104 and a refrigeration cycle is completed. This example cycle utilises two heat exchangers, condenser 106 and evaporator 111. In summary, refrigeration operating system 102 functions to transfer heat from within refrigeration cavity 103 to the surrounding environment, in the direction indicated generally by arrows 112 and 107.

Practical refrigeration systems differ from thermodynamically ideal refrigeration systems in respect of irreversibilities, which have a degrading effect on the efficiency and performance of the system. Since modem refrigeration operating systems require an external energy source to operate, an improvement in the overall efficiency of a refrigeration system can reduce the cost of running a refrigeration unit.

FIG. 2

Figure 2:
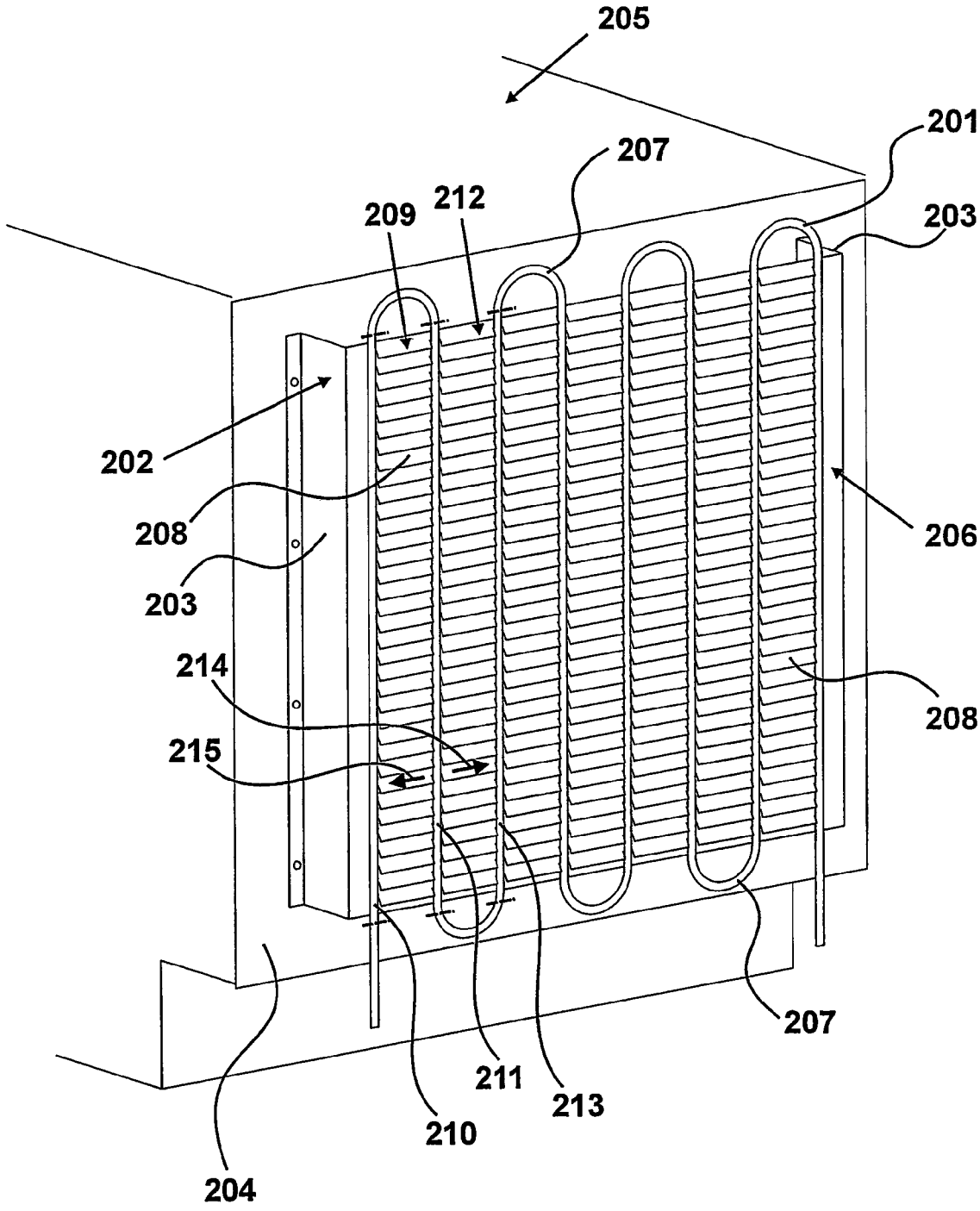
PRIOR ART Figure 2
FIG. 2 shows an example of a condenser in situ with respect to a refrigeration unit.

FIG. 2 shows an example of a condenser in situ with respect to a refrigeration unit. Condenser 201 comprises tubing in a serpentine shape. Condenser 201 is secured to a prior art cooling fin assembly 202, which has two side brackets 203 by means of which the cooling fin assembly 202 is secured to the rear external wall 204 of refrigeration unit 205. The condenser 201 is secured to cooling fin arrangement 202 such that there is heat transfer contact between the tubing of condenser 201 and the cooling fin arrangement 202. Condenser 201 is secured to the outward facing side 206 of cooling fin assembly 202, such that the cooling fin assembly is between the condenser 201 and the rear wall 204 of refrigeration unit 205. In the shown arrangement, the bends 207 of the serpentine shape of the condenser 201 extend beyond the top and bottom edges of the cooling fin assembly 202.

The cooling fin assembly 202 comprises a plurality of louvres 208 arranged according to a louvre pattern. Each louvre 208 is a ramp louvre, formed by making a first slit in a base plate, making two side slits extending in the same direction from and substantially perpendicular to the first slit, and then raising the material between the slits away from the base plate. The ramp louvres 208 are arranged in louvre columns between adjacent straight lengths of the condenser 201 tubing, for example in first louvre column 209 between first length 210 and second length 211, and second louvre column 212 between second length 211 and third length 213 of the condenser 201. Each ramp louvre 208 extends substantially parallel to the straight lengths of tubing, such that with the condenser 201 oriented such that the straight lengths of tubing are substantially vertical, the louvres 208 of the cooling fin arrangement 202 are substantially horizontal. The ramp louvres 208 are substantially mutually parallel within a column, and all project in the same direction, outwards from the outward facing side 206 of the cooling fin arrangement 202.

As previously described, condenser 201 functions to condense refrigerant entering therein. This process is the transfer of heat from the refrigerant to another fluid. As refrigerant flows through condenser 201, in either direction, heat is transferred from the refrigerant to the tubing of the condenser 201. In turn, there is a transfer of heat from the tubing of the condenser 201 to the cooling fin assembly 202. For example, heat from refrigerant passing through second tubing section 211 is transferred into first louvre column 209 and second louvre column 212, this heat transfer being indicated generally by arrows 214 and 215. In turn, there is a heat transfer from the cooling fin assembly 202 to the surrounding environment. In addition, there is heat transfer from any exposed tubing surface of the condenser 201 to the surrounding environment. The exchange of heat from the refrigerant to the surrounding environment is affected by fluid flow, in this case air flow, about the cooling fin assembly 202 and condenser 201 combination.

FIG. 3

Figure 3:
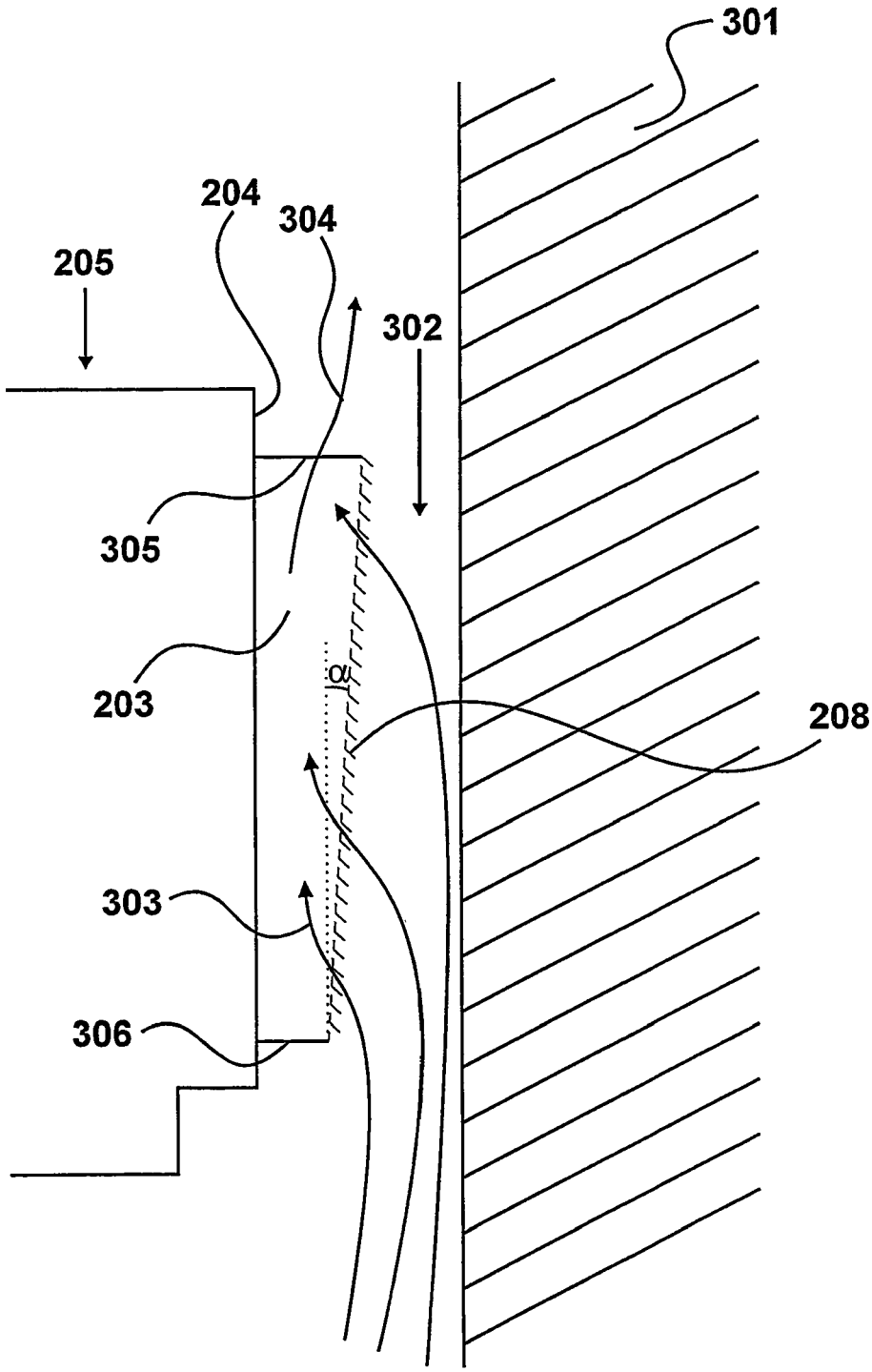
PRIOR ART Figure 3
FIG. 3 shows the refrigeration unit of FIG. 2 positioned with respect to a wall.

FIG. 3 shows the refrigeration unit 205 of FIG. 2 positioned with respect to a room wall 301. The refrigeration unit 205 is oriented with respect to the wall 301 such that the external rear wall 204 of refrigeration unit 205 faces towards the room wall 301. The refrigeration unit 205 is spaced a distance away from room wall 301 such that there is a chimney 302, between the condenser 201 (not shown in FIG. 3) and cooling fin arrangement 202 combination and the room wall 301, within which air can flow.

Air adjacent the cooling fin assembly 202 is heated by conduction as refrigerant flows through condenser 201. The heated air rises, causing air to be drawn up from below. In this way, a natural flow of air is created causing heat to be transferred from the cooling fin assembly 202 by convection. Arrow 303 indicates generally a flow of air from the bottom end of the refrigeration unit 205, flowing along the outward facing side of the cooling fin assembly 202. This flow of air passes through a louvre 208 to the inward facing side of the cooling fin assembly 202, whereafter the air flows up between the cooling fin assembly 202 and the rear wall 204 of the refrigeration unit 205 into the surrounding environment, indicated generally by arrow 304.

Since each ramp louvre 208 of cooling fin assembly 202 projects outwards therefrom, in order to optimise the efficiency of prior art cooling fin assembly 202, the cooling fin assembly 202 is mounted with respect to the rear wall 204 of refrigeration unit 205 such that the cooling fin assembly 202 is angled from vertical, indicated generally by angle $\alpha$, with the top edge of cooling fin assembly 202 being closer to wall 301 than the bottom edge. Typically, angle $\alpha$ is approximately 1-2°. In the shown example, to achieve this incline, the top edge 305 of each cooling fin assembly side bracket 203 is longer than the bottom edge of each cooling fin assembly side bracket 203.

FIG. 4

Figure 4:
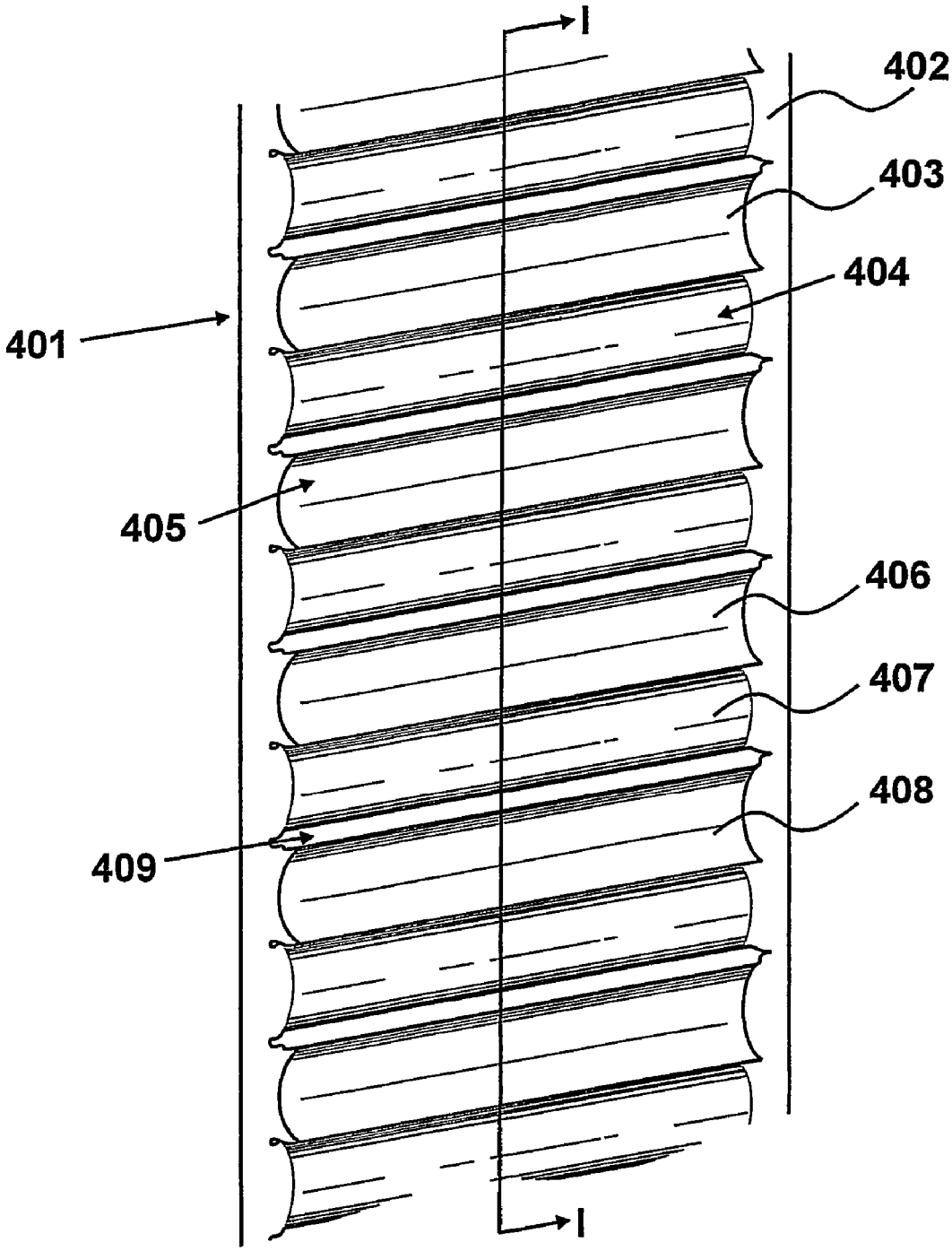
FIG. 4 shows a heat exchanger cooling fin having a series of louvres.

FIG. 4 shows a heat exchanger cooling fin 401. Heat exchanger cooling fin 401 is suitable for use in an open or closed fluid flow environment, in which fluid is able to flow. Heat exchanger cooling fin 401 is suitable for use with a static heat exchanger, with which heat exchange is effected by free convection, and is suitable for use with a dynamic heat exchanger, with which heat exchange is effected by forced convection. Heat exchanger cooling fin 401 comprises a fin plate 402 having a plurality of louvres 403 in a series, the series of louvres 403 configured to allow fluid flow from a first side of the fin plate 402 to the other side and back again to the first side, as the fluid flows along the series of louvres 403. The louvres 403 are configured to be functional when the louvre series is oriented vertically, as shown in FIG. 4, although the efficient functionality of the louvres 403 is not limited to this orientation.

Referring to the example series shown in FIG. 4, the louvres 403 are substantially mutually parallel within the series. Each louvre 403 has a convex curved surface, for example convex curved surface 404. In the example shown, each louvre 403 has, on the reverse side, a concave curved surface, for example concave curved surface 405. As shown in FIG. 4, the convex curved surface of each louvre 403 has four edges, two opposite open edges and two opposite "closed" edges connected to the fin plate 402, with the open edges offset from the nominal plane of the fin plate 402.

The louvres 403 are arranged according to a louvre pattern in which the convex curved surface of each louvre 403 faces in the opposite direction to the convex curved surface of each adjacent louvre 403. For example, the convex curved surface of louvre 406 is facing in the opposite direction to the convex curved surface of louvre 407, which is positioned next to a first open edge of louvre 406, and in the opposite direction to the convex curved surface of adjacent louvre 408, which is positioned next to the other open edge of louvre 406. Between adjacent open edges of adjacent louvres 403 is a flow aperture, for example flow aperture 409, to allow fluid to flow therethrough, from one side of the fin plate 402 to the other.

Figure 5:
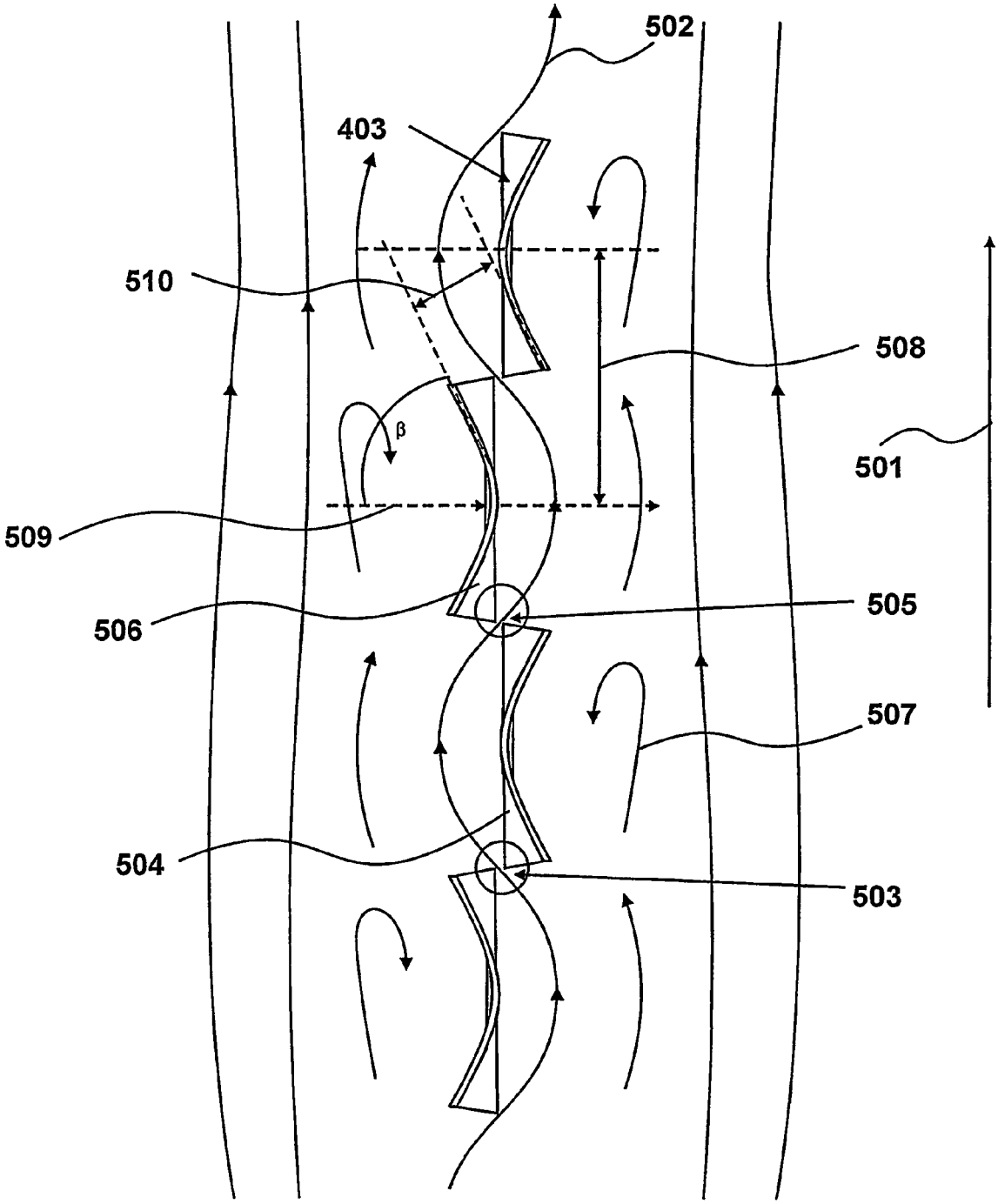
FIG. 5 is a schematic of fluid flow about the heat exchanger cooling fin of FIG. 4.

A section view along line I-I through fin plate 402 is shown in FIG. 5.

FIG. 5

FIG. 5 illustrates schematically fluid flow about the louvres 403 of fin plate 402, with a nominal fluid flow direction as indicated generally by arrow 501. As shown in FIG. 5, the series of louvres 403 define a nominal fluid path along the series, indicated generally by arrow 502; the path weaving through the fin plate 401 over the convex curved surface of each louvre 403.

For example, fluid flowing along the nominal fluid flow path 502 flows through flow aperture 503, from a first side of fin plate 402 to the other, over the convex curved surface of louvre 504 and through flow aperture 505 back to the first side of fin plate 402, over the convex curved surface of louvre 506 and so on. In this way, fluid flowing along the nominal fluid flow path 502 flows from one side of the fin plate 402 to the other. In this example, the fluid flow alternates from one side of fin plate 402 with each sequential louvre 403 along the series. However, other patterns of louvres 403 configured to direct fluid flow from one side of the plate to the other and back again are utilisable.

The configuration of the louvres 403 in the series is such that the flow of fluid follows generally the contour of the convex curved surface of each louvre 403. This effect is known as the Coanda Effect. Fluid flowing along nominal fluid flow path 502 flows over the convex curved surface of a louvre 403, for example louvre 504, following the contour thereof, and as the fluid flow is directed through a flow aperture between louvres 403, for example flow aperture 505, the fluid flow follows the convex curved surface of the subsequent louvre 403, for example louvre 506, flowing thereover. Thus, the curvature of the convex curved surface of each louvre 403 directs a flow of fluid thereover to flow from one side of the fin plate 402 to the other as the fluid flows along the series of louvres 403. For example, with the fin plate 402 used with a static heat exchanger positioned substantially vertically in air, heat is transferred from the louvres 403 to a stream of air flowing along the nominal fluid flow path 502, causing the air to rise. The series of louvres 403 directs the rising stream of air to continue flowing along, and not away from, the series of louvres 403. This effect functions to increase the degree of contact and the contact time between the flowing air and the louvres 403, and to increase the surface area of the series of louvres 403 over which the air flows.

In the example shown, the flow apertures between louvres are wide enough to allow for the thickness of any boundary layer developing on the surface. In addition, the configuration of the shown series of louvres 403 is such that turbulence, indicated generally by arrow 507, is created near the concave curved surface of each louvre 403. The turbulence is created by the open edges of the louvres 403 disturbing the fluid flow over each side of the fin plate 402. Turbulence improves heat transfer from the louvres 403 to the surrounding environment, and thus increases the efficiency of the heat exchanger cooling fin.

According to an example of the arrangement illustrated in FIG. 5, the distance between louvre centre points, indicated generally by doubleheaded arrow 508, is approximately 1.5 mm, the radius of the convex curved surface of each louvre, indicated generally by arrow 509 is approximately 7.5 mm, the angle between each open edge of a louvre and a line normal to the centre point of the louvre, indicated generally by angle β, is approximately 67.5°, and the width of the flow aperture between louvres, indicated generally by arrow 510, is approximately 3.3 mm.

FIG. 6

Figure 6:
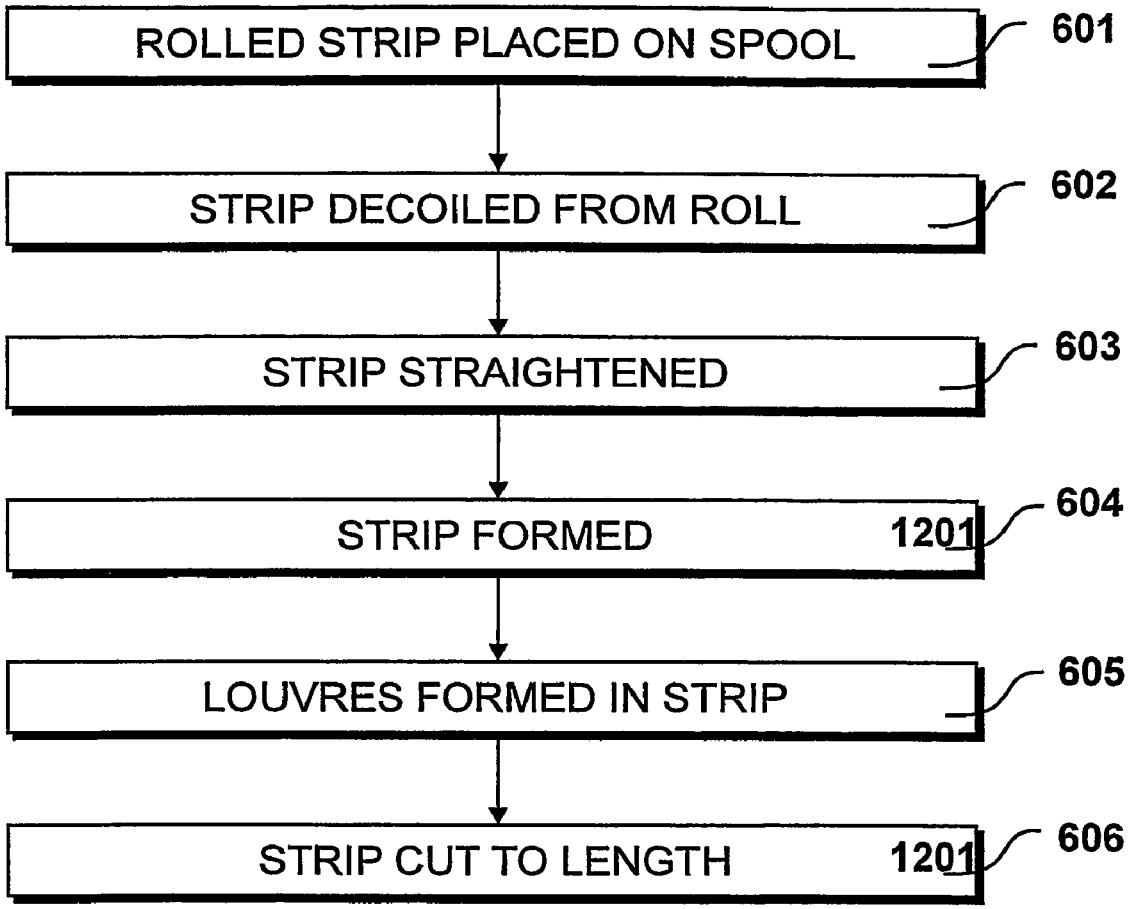
FIG. 6 is a flow diagram illustrating a process of manufacturing the heat exchanger cooling fin of FIG. 4.

A process for manufacturing heat exchanger cooling fin 401 is shown in FIG. 6. At step 601 a roll of metal strip is placed onto a spool. The free end of the rolled strip is fed through a decoiling mechanism at step 602. At step 603, the strip is straightened, for example by being fed through a straightening mechanism such as straightening rollers. At step 604, any forming of the strip, for example to form means for securing the manufactured cooling fin to a heat transfer element, is performed. At step 605, louvres are formed in the strip. A technique for forming the louvres involves making substantially parallel slits along the width of the strip, at regular intervals, and then using a stamping element, for example a stamping wheel, to press out the material between two strips, thus forming a series of louvres along the strip. At step 606, the louvred strip is cut to length. The strip may be cut according to, for example, length, number of louvres or by number of sets of louvres, for instance with two adjacent louvres forming a set.

According to an alternative process of manufacture, the strip is cut in lengths prior to the formation of louvres therewithin.

FIG. 7

Figure 7:
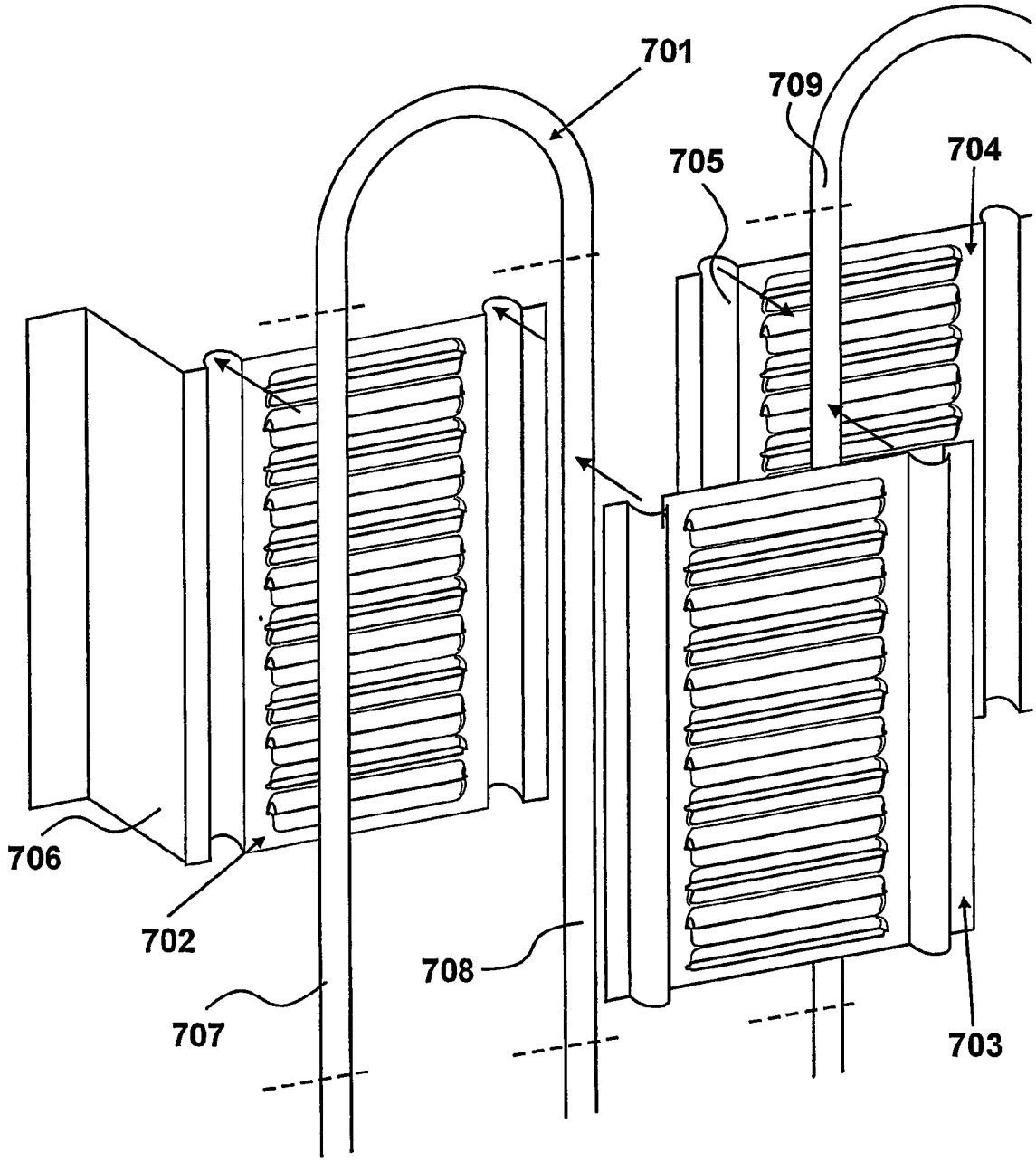
FIG. 7 illustrates a method of securing a plurality of heat exchanger cooling fins in heat transfer relationship with a heat transfer element.

FIG. 7 illustrates a method of securing a plurality of cooling fins to a heat transfer element. In order for the cooling fins to operate efficiently, a surface of each cooling fins is required to be in heat transfer contact with a surface of the heat transfer element. Since the louvres 403 are configured to direct fluid to flow from one side of the cooling fin plate to the other, and back again, the cooling fin is functional whichever way round it is fitted to a heat transfer element. Thus, cooling fins utilising the louvres 403, or louvres having the same functionality, are comparatively easier and quicker to use in manufacture.

In the example shown, the heat transfer element 701 comprises tubing formed in a serpentine shape. Each of the shown cooling fins 702, 703 and 704 have a channel, for example channel 705, extending along the length of the fin plate, to the inside of each side edge, substantially perpendicular to the louvres 403 thereof. Each channel is configured to partially receive the tubing of heat transfer element 701. End cooling fin 702 additionally has a side bracket 706 extending from one side thereof. Firstly, the end and next tubing lengths 707, 708 respectively of heat transfer element 701 are aligned with the two channels in the end cooling fin 702, and inserted therein. The next cooling fin, in this example, cooling fin 703, is oriented such that its channels face in the opposite direction to the channels of end cooling fin 702. Cooling fin 703 is then aligned with the heat transfer element 701 such that one channel fits over tubing section 708 and the other channel fits over the next tubing section 709. After this step, tubing section 708 is sandwiched between cooling fin 702 and cooling fin. Cooling fin 704 is then positioned with one channel over tubing section 709 and the other channel over the next tubing section.

To secure the cooling fins 702, 703, 704 in heat contact relationship with heat transfer element 701, the overlapping sections of the two cooling fins surrounding a tube are spot or seam welded together. Thus, this method does not involve welding on the heat transfer element. Other methods of securing the heat exchanger cooling fin in heat contact relationship with a heat exchanger element are utilisable. For example, the channels in cooling fin 702, 703, 704 may be configured to allow the tubing of the heat transfer element 701 to be recessed and retained therein by means of a snap fit arrangement.

FIG. 8

Figure 8:
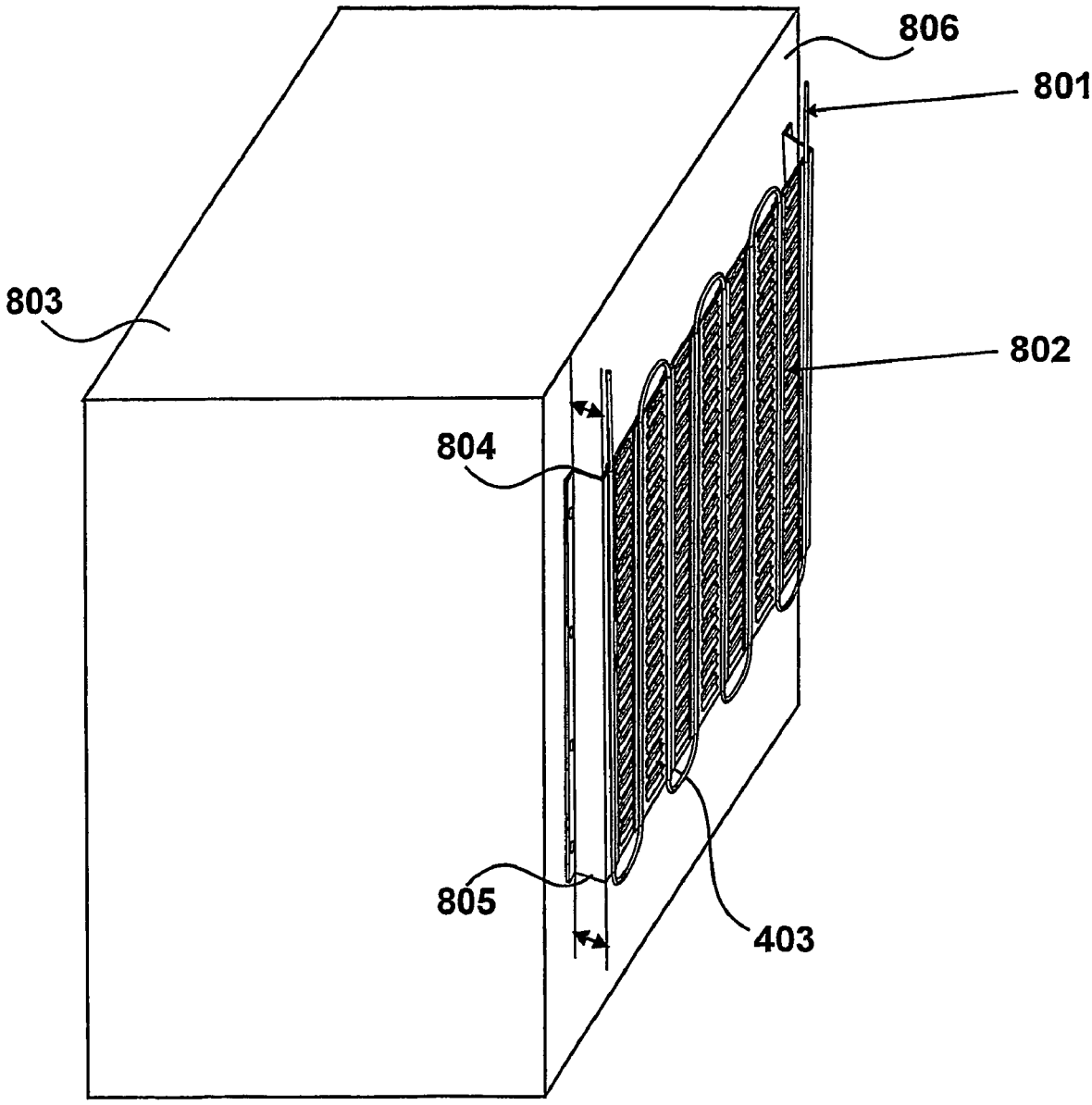
FIG. 8 shows a static heat exchanger having louvres as illustrated in FIG. 4.

FIG. 8 shows a static heat exchanger unit comprising a condenser 801 and cooling fin arrangement 802 combination, bracketed to the rear of a refrigeration unit 803. Condenser 801 comprises tubing in a serpentine shape, and cooling fin arrangement 802 is louvred, with a series of louvres 403 extending in a louvre column between straight lengths of the serpentine shape. As shown, cooling fin arrangement 802 has two side brackets 803. As previously described, the louvres 403 are configured to operate in a vertically oriented louvre column or series. Thus, since the series of louvres does not need to be oriented at an angle to the vertical, the top and bottom edges 804, 805 respectively are the same length, such that with the cooling fin arrangement 802 secured by the brackets 803 to the rear vertical wall 806 vertical surface, the cooling fin arrangement 802 and the louvre columns thereof will also be vertical The manufacture of the non-angled side brackets 805 is comparatively more convenient than the manufacture of angled side brackets. In addition, since the cooling fin arrangement does not require orientation at an incline, the required chimney width associated with the condenser 801 and cooling fin arrangement 802 is potentially reduced. This reduced chimney width feature may also provide for an increase in the volume of the internal refrigeration storage cavity.

FIG. 9

Figure 9:
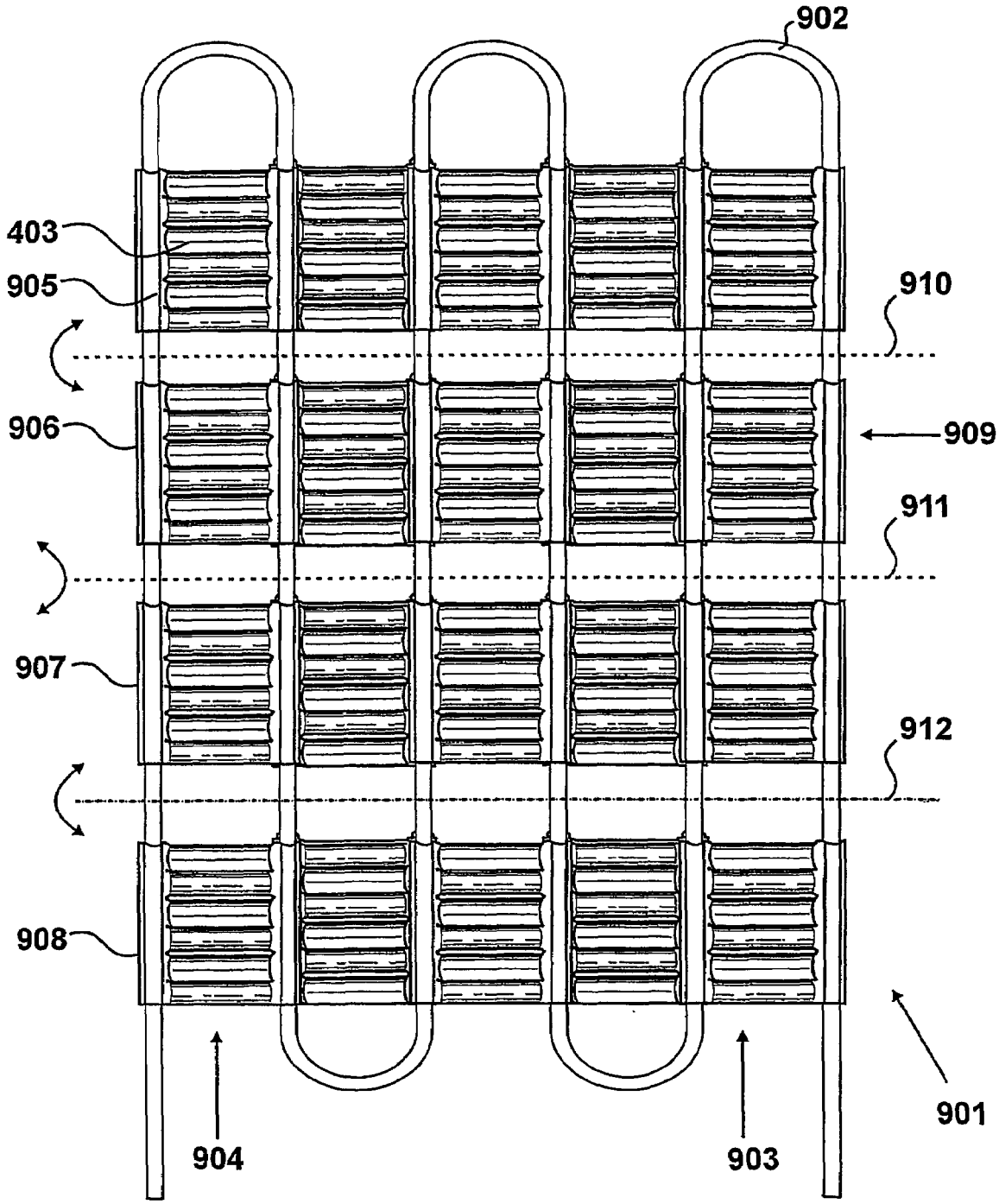
FIG. 9 shows a dynamic heat exchanger having louvres as illustrated in FIG. 4, in a first stage of manufacture.

FIG. 9 illustrates a dynamic heat exchanger unit 901, in a first stage of formation, comprising a condenser 902 and cooling fin arrangement 903 combination. Condenser 901 comprises tubing in a serpentine shape, and cooling fin arrangement 902 is louvred. Cooling fin arrangement 903 comprises four series of louvres 403 extending in a broken louvre column between straight lengths of the serpentine shape. For example louvre column 904 comprise four fin plates 905, 906, 907, 908 each having a series of louvres extending substantially parallel to the adjacent tubing lengths, spaced apart such that the louvre column 904 is effectively broken in three places. This arrangement is alignedly repeated across the serpentine of the condenser 901, to create four louvre rows across the heat exchanger unit 901, for example louvre row 908.

In the second stage of the formation of heat exchanger unit 901, the condenser 902 and cooling fin arrangement 902 combination, in the arrangement shown in FIG. 9, is concertinaed. The arrangement undergoes a first bending operation, to bend the arrangement about dotted line 910 such that the louvre rows either side of dotted line 909 are brought substantially parallel with each other. A second bending operation is performed on the arrangement, to bend the arrangement about dotted line 911, in the opposite direction to the bend about dotted line 909, such that the louvre rows either side of dotted line 909 are brought substantially parallel with each other. A third bending operation is performed on the arrangement to bend the arrangement about dotted line 912, in the opposite direction to the bend about dotted line 911 (in the same direction as the bend about dotted line 910), such that the louvre rows either side of dotted line 912 are brought substantially parallel with each other.

FIG. 10

Figure 10:
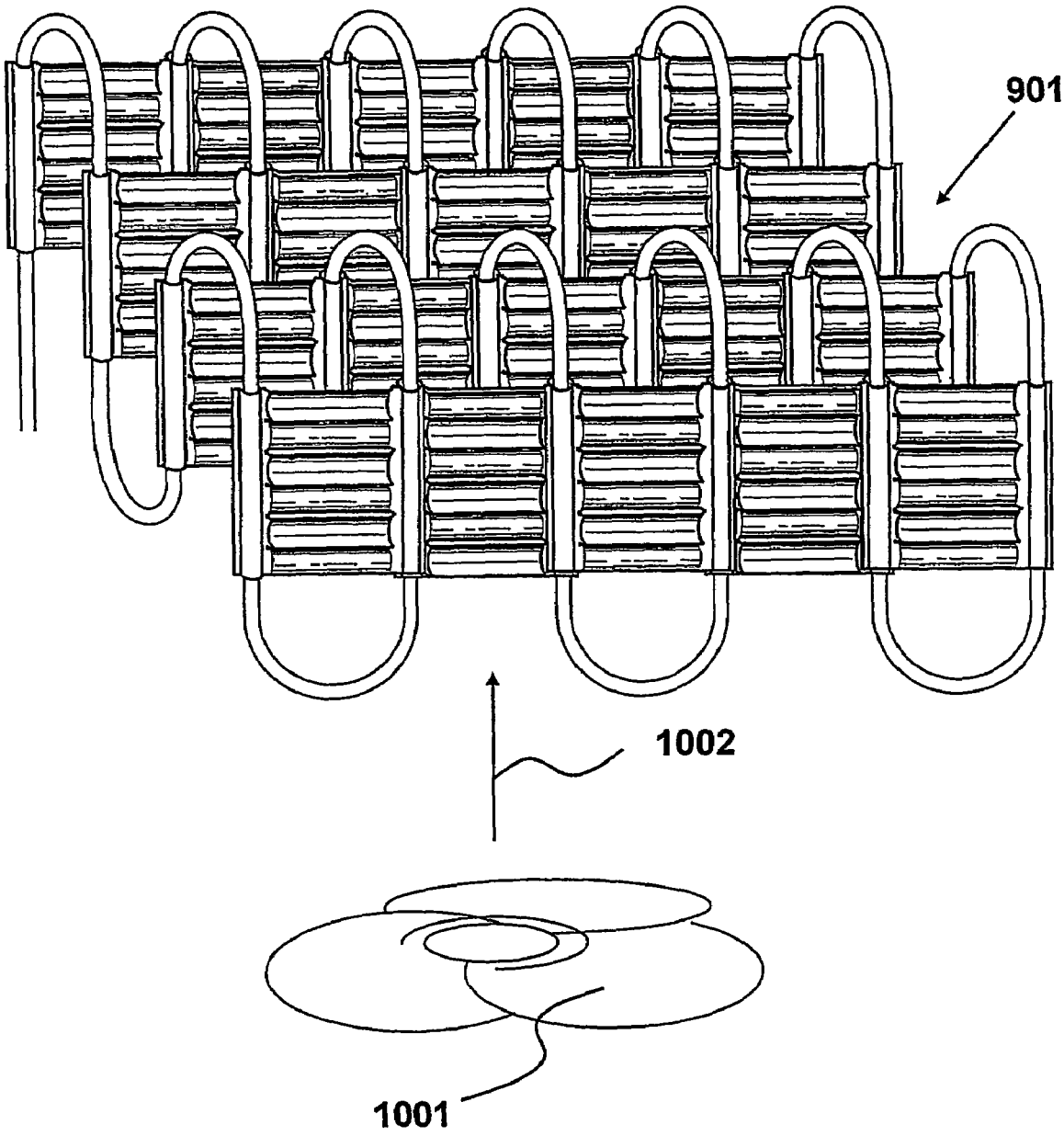
FIG. 10 shows the dynamic heat exchanger of FIG. 9, following a second stage of manufacture.

FIG. 10 shows the heat exchanger unit 901 as shown in FIG. 9, following the aforedescribed second stage of formation, whereafter the condenser 902 and cooling fin arrangement 903 combination itself has a serpentine shape.

As shown in FIG. 10, heat exchanger unit 901 is configured for use with a forced flow of air, for example with a flow of air created by fan 1001, with a nominal fluid flow direction as generally indicated by arrow 1002, flowing in the direction along the series of louvres 403.

The invention claimed is:

1. A heat exchanger cooling fin for use in a fluid flow environment, comprising a fin plate having a series of substantially mutually parallel louvres each louvre having two opposite open edges such that adjacent open edges of adjacent louvres define a flow aperture, each louvre having a convex curved surface that faces in the opposite direction to a convex curved surface of each adjacent louvre, said series of louvres defining a nominal fluid flow path along the series over said convex curved surface of each louvre wherein said louvres are arranged such that fluid flowing from a first side of said fin plate through a first flow aperture to the second side of the fin plate and over a first louvre, follows a curved contour of the convex surface of said first louvre through a second flow aperture to the first side of the fin plate and over the convex curved surface of a second louvre adjacent to said first louvre.

2. A heat exchanger cooling fin according to claim 1, comprising a channel configured to partially or fully receive tubing therein.

3. A heat exchanger cooling fin according to claim 2, comprising a channel configured to partially receive tubing therein configured to enable tubing to push fit therein.

4. A heat exchanger having a heat exchanger cooling fin according to claim 1, for use in a fluid flow environment, said heat exchanger cooling fin comprsing a fin plate having a series of louvres arranged to direct fluid flow from a first side of said fin plate to the second side of the fin plate and back to said first side of the fin plate, and said heat exchanger comprising tubing in heat transfer contact with the fin plate, said tubing extending in a direction along said series of louvres.

5. A heat exchanger having a heat exchanger cooling fin according to claim 1, for use in a fluid flow environment, said heat exchanger cooling fin comprising a fin plate having a series of louvres arranged to direct free convection fluid flow from a first side of said fin plate to the second side of the fin plate and back to said first side of the fin plate.

6. A heat exchanger cooling fin according to claim 1, wherein the open edges of each louvre are offset from a nominal plane of the fin plate, and the convex curved surface of each louvre extends from said edges away from the nominal plane.

7. A heat exchanger comprising a cooling fin for use in a fluid flow environment, said cooling fin comprising a fin plate having a series of substantially mutually parallel louvres each louvre having two opposite open edges such that adjacent open edges of adjacent louvres define a flow aperture, each louvre having a convex curved surface that faces in the opposite direction to a convex curved surface of each adjacent louvre, said series of louvres defining a nominal fluid flow path along the series over said convex curved surface of each louvre, wherein said louvres are arranged such that fluid flowing from a first side of said fin plate through a first flow aperture to the second side of the fin plate and over a first louvre, follows a curved contour of the convex surface of said first louvre through a second flow aperture to the first side of the fin plate and over the convex curved surface of a second louvre adjacent to said first louvre.

8. A heat exchanger according to claim 7, wherein said cooling fin comprises a channel and said heat exchanger further comprises tubing partially or fully received within said channel.

9. A heat exchanger according to claim 8, wherein said tubing is a push fit within said channel of said cooling fin.

10. A heat exchanger according to claim 7, wherein the open edges of each louvre are offset from a nominal plane of the fin plate, and the convex curved surface of each louvre extends from said edges away from the nominal plane.

11. A heat exchanger according to claim 7, comprising tubing in heat transfer contact with the fin plate, said tubing extending in a direction along said series of louvres.

12. A heat exchanger according to claim 7, wherein said cooling fin comprises a fin plate having a series of louvres arranged to direct free convection fluid flow from a first side of said fin plate to the second side of the fin plate and back to said first side of the fin plate.

13. A heat exchanger according to claim 7, comprising tubing in heat transfer contact with said cooling fin, wherein the heat exchanger comprises a plurality of fin plates and the tubing between adjacent fin plates is bent such that a fin plate is arranged to be substantially parallel with the other fin plates.

14. A refrigeration unit having a heat exchanger according to claim 7, wherein said heat exchanger is a condenser.

15. A refrigeration unit having a heat exchanger cooling fin according to claim 7, wherein said heat exchanger is positioned substantially vertically in air, such that air flows along said nominal fluid flow path by convection.

16. A refrigeration unit having a heat exchanger cooling fin according to claim 7, wherein said refrigeration unit comprises a fan configured to provide a forced flow of air to said heat exchanger cooling fin.

17. A heat exchanger cooling fin for use in a fluid flow environment, comprising a fin plate having a series of substantially mutually parallel louvres each louvre having two straight edges and a convex surface curved from one such edge to the other and facing in the opposite direction to the convex curved surface of each adjacent louvre, wherein edges of adjacent louvres define a flow aperture of generally uniform width along said edges, said series of louvres defining a nominal flow path along the series over said convex curved surface of each louvre.

18. A heat exchanger cooling fin for use in a fluid flow environment as claimed in claim 17 wherein said edges are spaced from said fin plate with each edge of a fin positioned on the opposite side of said plate from an edge of an adjacent fin.

19. A heat exchanger comprising a cooling fin for use in a fluid flow environment, comprising a fin plate having a series of substantially mutually parallel louvres each louvre having two straight edges and a convex surface curved from one such edge to the other and facing in the opposite direction to the convex curved surface of each adjacent louvre, wherein edges of adjacent louvres define a flow aperture of generally uniform width along said edges, said series of louvres defining a nominal flow path along the series over said convex curved surface of each louvre.

20. A heat exchanger according to claim 19, wherein said cooling fin comprises a channel and said heat exchanger further comprises tubing partially or fully received within said channel.

21. A heat exchanger according to claim 20, wherein said tubing is a push fit within said channel of said cooling fin.

22. A heat exchanger according to claim 19, wherein the open edges of each louvre are offset from a nominal plane of the fin plate, and the convex curved surface of each louvre extends from said edges away from the nominal plane.

23. A heat exchanger as claimed in claim 19 wherein said edges are spaced from said fin plate with each edge of a fin positioned on the opposite side of said plate from an edge of an adjacent fin.

* * * * *